US009387583B1

(12) United States Patent
Coan

(10) Patent No.: US 9,387,583 B1
(45) Date of Patent: Jul. 12, 2016

(54) POOL SKIMMER RETRIEVAL TOOL

(71) Applicant: Tim Coan, Tallassee, AL (US)

(72) Inventor: Tim Coan, Tallassee, AL (US)

( * ) Notice: Subject to any disclaimer, the term of this patent is extended or adjusted under 35 U.S.C. 154(b) by 0 days.

(21) Appl. No.: 14/643,733

(22) Filed: Mar. 10, 2015

(51) Int. Cl.
*B25J 1/04* (2006.01)
*E04H 4/14* (2006.01)

(52) U.S. Cl.
CPC .... *B25J 1/04* (2013.01); *E04H 4/14* (2013.01)

(58) Field of Classification Search
CPC ..... B25J 1/02; B25J 1/04; E04H 4/14; E04H 4/1272
USPC ..... 294/23, 24, 100, 175, 209
See application file for complete search history.

(56) References Cited

U.S. PATENT DOCUMENTS

| | | | | |
|---|---|---|---|---|
| 705,775 | A * | 7/1902 | Moore | 294/5.5 |
| 828,012 | A * | 8/1906 | Armstrong | 294/24 |
| 6,422,623 | B1 * | 7/2002 | Thomas | 294/24 |
| 7,309,088 | B2 * | 12/2007 | Fiore et al. | 294/24 |
| 8,042,849 | B2 * | 10/2011 | Pratt | 294/19.3 |
| 8,047,589 | B1 * | 11/2011 | Trainor | 294/24 |
| 8,091,934 | B2 * | 1/2012 | Bair | 294/24 |
| 2014/0327257 | A1 * | 11/2014 | Vazquez | 294/24 |

* cited by examiner

*Primary Examiner* — Dean Kramer
(74) *Attorney, Agent, or Firm* — C. Brandon Browning; Maynard, Cooper & Gale, PC

(57) ABSTRACT

The present disclosure generally pertains to a lifting tool for the manipulation of both a pool skimmer lid and skimmer basket. In certain embodiments, the lifting tool includes at least one hook configured to lift a skimmer basket. In other embodiments, the spacing between two or more hooks may be adjusted. In certain embodiments, the lifting tool includes a disc, configured to lift a skimmer lid and positioned perpendicular to the length of the lifting tool. In certain embodiments, the length of the lifting tool may be increased or decreased to suit the preferences of the user.

17 Claims, 7 Drawing Sheets

POOL SKIMMER RETRIEVAL TOOL

RELATED ART

Swimming pools require consistent maintenance, including, but not limited to, the removal of debris. If not removed, debris may cause a number of problems, such as undesirable changes in the pH of the pool water, clogging of the pool's water circulation systems, and the presence of insects or undesirable objects within the pool. To combat debris, many pools are constructed to include perforated skimmer baskets, which continuously filter debris from the water by trapping debris within baskets before the water recirculates into the pool. As a result, these baskets may frequently become clogged with debris and must be retrieved, emptied and replaced to ensure proper functionality.

The retrieval of skimmer baskets from the skimmer wells is often both inconvenient and unpleasant. Skimmer well lids are mounted flush with the floor of the pool deck with only small openings by which they may be pried up. Further, manual removal of a skimmer basket requires the user to extend their hand into the basket, which may be filled with insects, snakes or other hazards, hidden by the other debris.

Therefore, it is desirable for those performing pool maintenance, particularly for those with lower back pain, to have a lifting tool configured to lift both a skimmer lid and basket from a skimmer well without the need to bend over or to touch the skimmer lid and basket.

BRIEF DESCRIPTION OF THE DRAWINGS

The present disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

The present disclosure generally pertains to a lifting tool for the manipulation of both a pool skimmer lid and skimmer basket. In certain embodiments, the lifting tool includes at least one hook configured to lift a skimmer basket. In other embodiments, the spacing between two or more hooks may be adjusted. In certain embodiments, the lifting tool includes a disc, configured to lift a skimmer lid and positioned perpendicular to the length of the lifting tool. In certain embodiments, the length of the lifting tool may be increased or decreased to suit the preferences of the user.

The use of any and all examples, or exemplary language ("e.g.," "such as," or the like) provided herein, is intended merely to better illuminate the embodiments and does not pose a limitation on the scope of the embodiments.

As used herein, "alloy" means pure metals and metals including incidental impurities and/or purposeful additions of metals and/or non-metals. For example, alloy may mean aluminum. Other examples of alloys include brass, bronze, copper, duralumin, Inconel, nickel, steel, titanium, other alloys known to those skilled in the art, and combinations of the same.

As used herein, "composite" means engineered materials made from two more constituent materials. Examples of composites include, but are not limited to, carbon composites, in which carbon fiber is embedded in a matrix or resin, including epoxy matrices, thermosetting or thermoplastic resins, as well as composites containing fiberglass, ceramics, and other elements.

As used herein, a "hook" means any protruding member that can be used to hang or hoist an object. A hook can be strait, curved, angled or any combination thereof. A hook can be a separate element or integrally molded with the body of an adapter, such as a crossmember.

Figure 1:
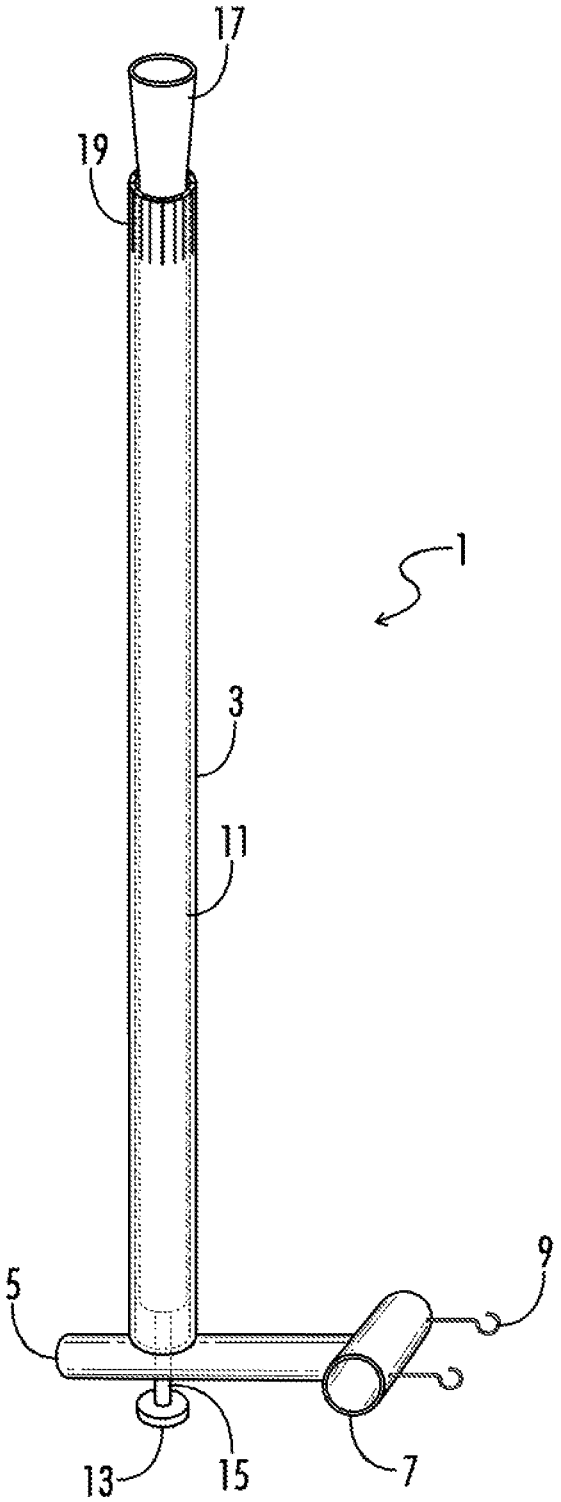
FIG. 1 depicts a perspective view of the skimmer lifting tool wherein the button is pressed.

FIG. 1 depicts an exemplary embodiment of the lifting tool 1, which includes an elongated body 3, which is hollow. In certain embodiments, the elongated body 3 is cylindrical. One end of the elongated body 3 is a splayed end 19. In certain embodiments, the splayed end 19 includes at least one notch to form a notched end to allow expansion of the splayed end 19. In other embodiments, the splayed end 19 is made of a flexible material capable of expanding.

The other end of the elongated body 3 is attached to a perpendicular crossmember 5. In certain embodiments, the crossmember is cylindrical. One end of the crossmember 5 is attached to the center of the length of a secondary crossmember 7, which is positioned perpendicularly to the crossmember 5. In certain embodiments, the secondary crossmember 7 is cylindrical.

As depicted in FIG. 1, two hooks 9 are parallel and affixed to the surface of the secondary crossmember 7 distal from the crossmember 5. In other embodiments, at least one hook is affixed to the crossmember 5. In certain embodiments, the secondary crossmember 7 includes multiple apertures, incrementally spaced at uniform distances, configured to accept hooks 9 such that a user may adjust the spacing between the hooks 9. In certain embodiments, the attachment points are threaded, such that they may accept hooks 9 with a similarly-threaded base.

The elongated body 3 is hollow, within which an inner rod 11 is located. In certain embodiments, the inner rod 11 is cylindrical. A button 13 is attached to one end of the inner rod 11 by a connector 15 which passes through the crossmember 5. In certain embodiments, the button 13 is a disc. The opposing end of the inner rod 11 is an outwardly tapered end 17 such that diameter of the end of the inner rod 11 is greater than the diameter at the center of the inner rod 11. In FIG. 1, the button 13 is depressed such that the tapered end 17 of the inner rod 11 is not in contact with the splayed end 19 of the elongated body 3.

In certain embodiments the lifting tool 1 is formed in one piece and is made of a rigid material. Rigid materials include, but are not limited to, plastic, alloy, wood, composites and other like materials known in the art. In certain embodiments, the exterior of the splayed end 19 is coated with a material with a high coefficient of friction, such as rubber, suitable to enhance the ability of the splayed end 19 to grip the skimmer well lid 21.

Figure 2:
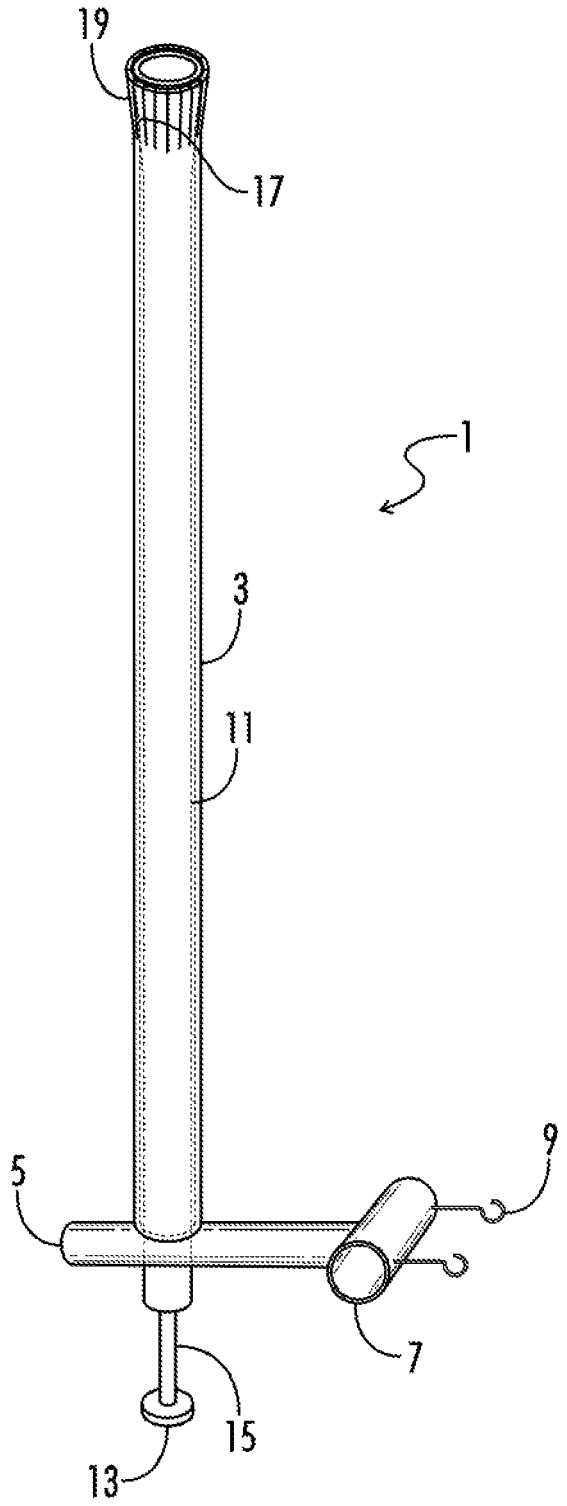
FIG. 2 depicts a perspective view of the skimmer lifting tool wherein the button is retracted.
Figure 3:
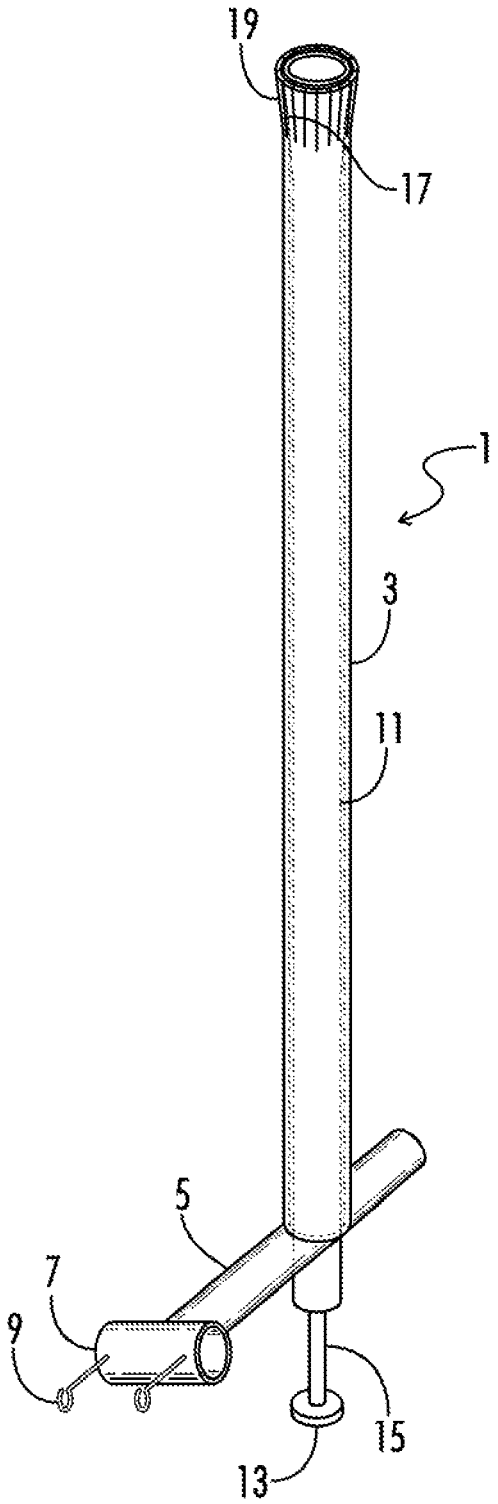
FIG. 3 depicts a second perspective view of the skimmer lifting tool wherein the button is retracted.

FIGS. 2 and 3 depict an exemplary embodiment of the skimmer lifting tool 1 wherein the button 13 is retracted, or pulled away from the crossmember 5, such that the tapered end 17 is in contact with interior surface of the splayed end 19 of the elongated body 3. The splayed end 19 is configured such that it expands when in contact with the tapered end 17.

Figure 4:
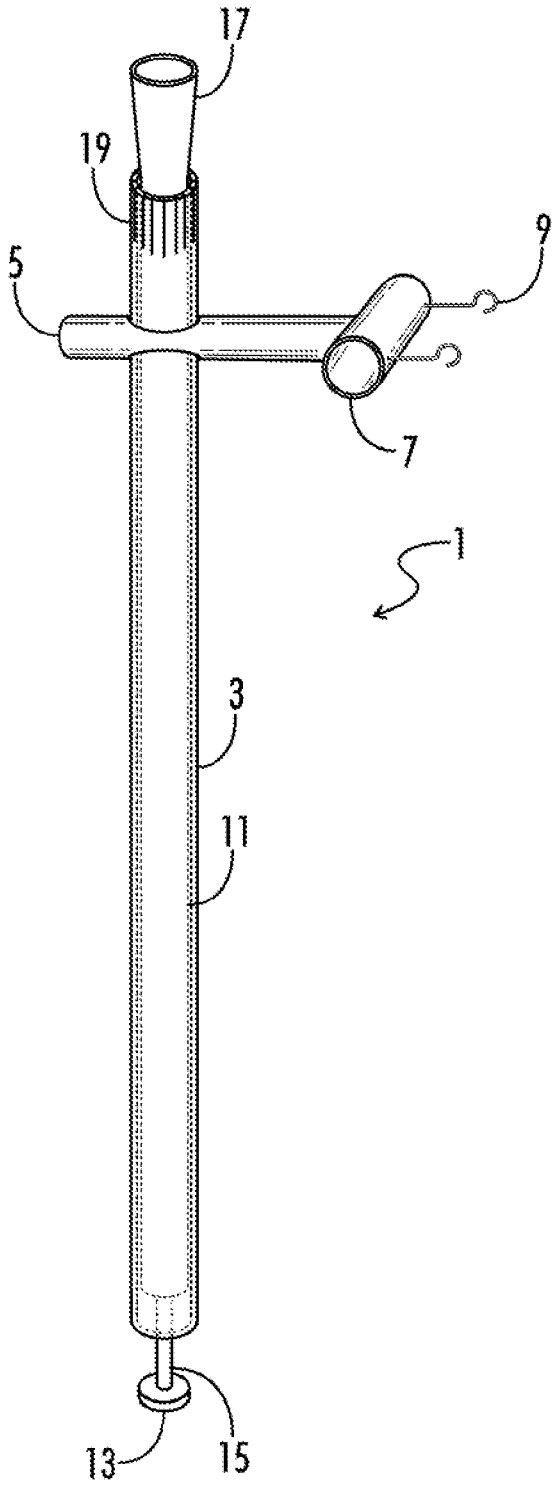
FIG. 4 depicts a perspective view of an alternative configuration of the skimmer lifting tool wherein the button is pressed.

FIG. 4 depicts an alternative embodiment of the skimmer lifting tool 1 wherein the tapered end 17 and splayed end 19 are proximal to the crossmember, the button 13 attaches to the end of the inner rod 11 distal from the tapered end 17 by a connector 15, and the connector 15 transverses the exterior surface of the end of the elongated body 3 distal from the splayed end 19.

Figure 5:
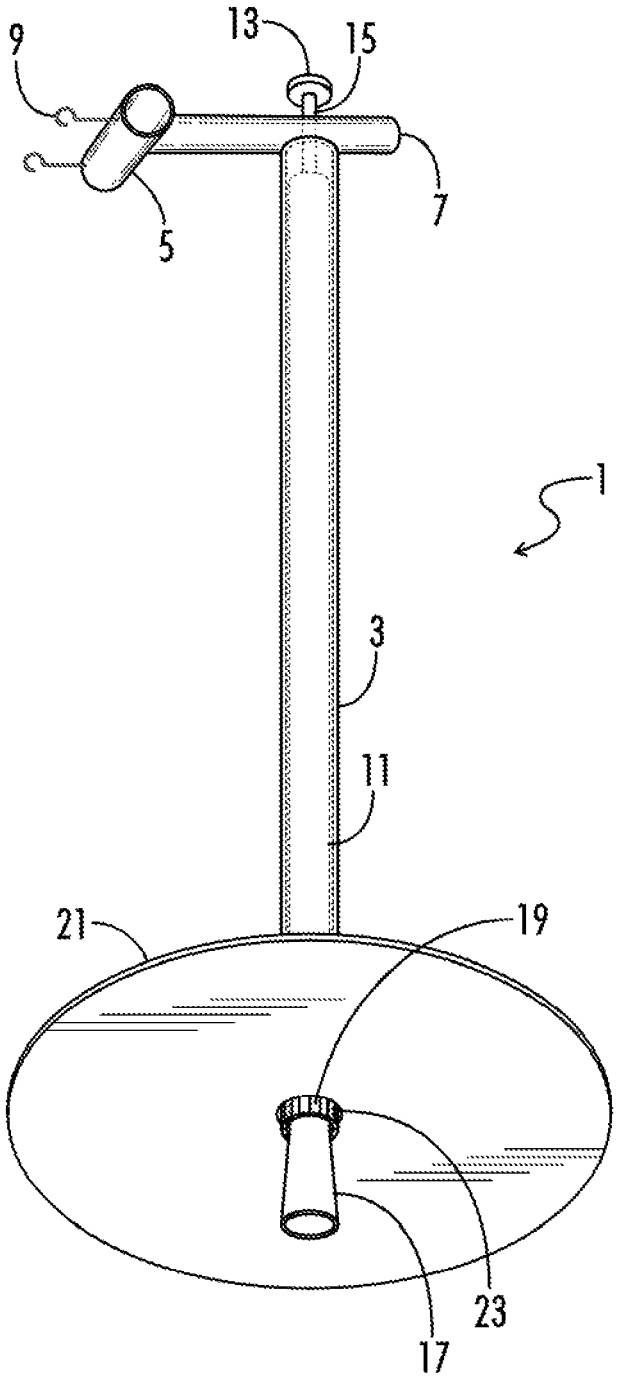
FIG. 5 depicts the skimmer lifting tool lifting a skimmer well lid wherein the button is pressed.
Figure 6:
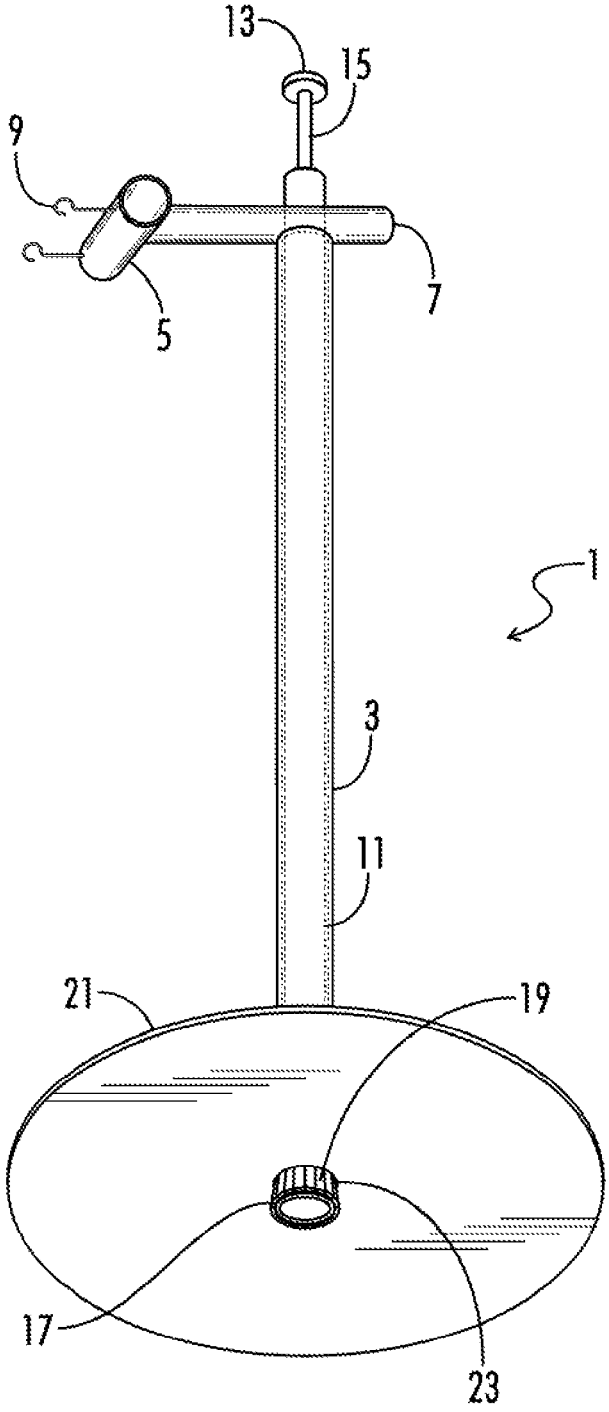
FIG. 6 depicts the skimmer lifting tool lifting a skimmer well lid wherein the button is pressed.

FIGS. 5 and 6 depict an exemplary embodiment of the skimmer lifting tool 1 lifting a skimmer well lid. In certain embodiments, the present disclosure contemplates a method of lifting a pool skimmer well lid 21 using a lifting tool 1 by: inserting the splayed end 19 approximately perpendicular relative to the skimmer well lid 21 into central hole 23 of the skimmer well lid 21; retracting the button 13, thereby causing the tapered end 17 to contact the inner surface of the splayed end 19, causing the diameter of the splayed end 19 to expand to contact the central hole 23 of the skimmer lid 21; and moving the skimmer well lid 21 by moving the lifting tool 1. The skimmer well lid 21 may be released by compressing the button 13, causing the tapered end 17 to extend away from the splayed end 19, thereby causing the diameter of the splayed end 19 to contract and cease contact with the central hole 23 of the skimmer well lid 21. FIG. 5, for example, depicts the splayed end 19 inserted through the central hole 23 of the skimmer well lid 21 wherein the button 13 is pressed, whereas FIG. 6 depicts the splayed end 19 inserted through the central hole 23 of the skimmer well lid 21 wherein the button 13 is retracted such that the splayed end 19 is expanded relative to the splayed end 19 depicted in FIG. 5.

Figure 7:
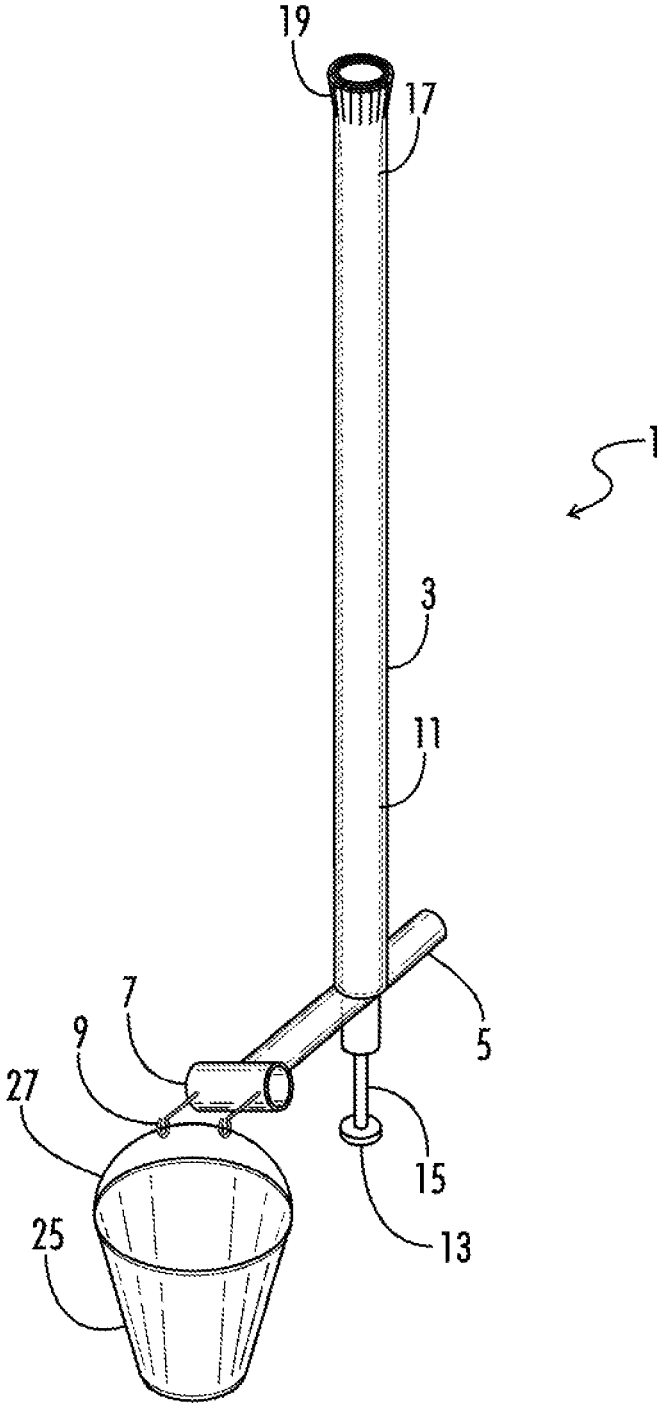
FIG. 7 depicts the skimmer lifting tool lifting a skimmer basket.

FIG. 7 depicts an exemplary embodiment of the skimmer lifting tool 1 lifting a pool skimmer basket 25. In certain embodiments, the present disclosure contemplates a method of lifting a pool skimmer basket 25 using a lifting tool 1 by: inserting the hooks 9 into the skimmer basket 25; securing the skimmer basket handle 27 using the hooks 9; and moving the skimmer basket 25 by moving the lifting tool 1. As shown in FIG. 7, the skimmer basket handle 27 may pivot on opposing edges of the top of the skimmer basket 25. In other embodiments, the skimmer basket handle 27 is a bar (not shown) along the diameter of the top of the skimmer basket 25.

A user may grip the lifting tool 1 on the elongated body 3. In certain embodiments, a portion, or all, of the exterior surface of the elongated body 3 is coated with a material with a high coefficient of friction, such as rubber, suitable to enhance the ability of a user to grip the lifting tool 1. In certain embodiments, a portion of such exterior coating is molded to fit a user's grip. In certain embodiments, a handle is attached to the elongated body 3 proximal to the splayed end 19. Such handles may include, but are not limited to, D-shaped and T-shaped handles and other handles known in the art.

References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

The various embodiments described herein are exemplary. Various other embodiments for the systems described herein are possible.

Now, therefore, the following is claimed:

1. A skimmer lifting tool, comprising:

an elongated body;

wherein the elongated body is hollow and open at both ends;

wherein a first end of the elongated body includes at least one notch;

wherein a second end of the elongated body is attached to a crossmember positioned approximately perpendicular relative to the elongated body;

wherein one end of the crossmember is attached to a secondary crossmember positioned approximately perpendicular relative to both the crossmember and the elongated body;

wherein at least one hook is attached to the secondary crossmember;

an inner rod located within an interior of the elongated body, and spanning approximately the length, of the elongated body;

wherein the a first end of the inner rod proximal to the first end of the elongated body is tapered outward; and wherein a second end of the inner rod is connected to a button outside of the crossmember by a connector that transverses the crossmember.

2. The skimmer lifting tool of claim 1, wherein the elongated body is a tube.

3. The skimmer lifting tool of claim 1, wherein one or more hooks are attached to the secondary crossmember through apertures configured to accept the hooks.

4. The skimmer lifting tool of claim 1, wherein the exterior surface of the first end of the elongated body is coated with rubber.

5. The skimmer lifting tool of claim 1, wherein the lifting tool is composed substantially of an alloy.

6. The skimmer lifting tool of claim 1, wherein the lifting tool is composed substantially of plastic.

7. The skimmer lifting tool of claim 1, wherein the lifting tool is composed substantially of a composite.

8. A skimmer lifting tool, comprising:

an elongated body;

wherein the elongated body is hollow;

wherein the elongated body transverses a crossmember positioned approximately perpendicular relative to the elongated body such that the lengths of the elongated body on either side of the crossmember are not equal;

wherein a first end of a shorter portion of the elongated body is open and includes at least one notch;

wherein one end of the crossmember is attached to a secondary crossmember positioned approximately perpendicular relative to both the crossmember and the elongated body;

wherein at least one hook is attached to the secondary crossmember;

an inner rod located within an interior of the elongated body, and spanning approximately the length, of the elongated body;

wherein a first end of the inner rod proximal to the first end of the shorter portion of the elongated body is tapered outward; and wherein a second end of the inner rod distal from the first end of the shorter portion of the elongated body is connected to a button by a connector that transverses a second end of the elongated body.

9. The skimmer lifting tool of claim 8, wherein the elongated body is cylindrical.

10. The skimmer lifting tool of claim 8, wherein the one or more hooks are attached to the secondary crossmember through apertures configured to accept the hooks.

11. The skimmer lifting tool of claim 8, wherein the exterior surface of the first end of the shorter portion of the elongated body is coated with rubber.

12. The skimmer lifting tool of claim 8, wherein the lifting tool is composed substantially of an alloy.

13. The skimmer lifting tool of claim 8, wherein the lifting tool is composed substantially of plastic.

14. The skimmer lifting tool of claim 8, wherein the lifting tool is composed substantially of a composite.

15. A method of lifting a skimmer well lid using the lifting tool of claim 1, comprising the steps of:

inserting the first end of the elongated body into a central hole of a skimmer well lid;

retracting the button, thereby causing the first end of the inner rod to contact the inner surface of the first end of the elongated body, causing the diameter of the first end of the elongated body to expand to contact the central hole of the skimmer well lid; and moving the skimmer well lid by moving the lifting tool.

16. The method of claim 15, further comprising the step of releasing the skimmer well lid by compressing the button, causing the first end of the inner rod to cease contact with the inner surface of the first end of the elongated body, causing the diameter of the first end of the elongated body to decrease and cease contact with the central hole of the skimmer well lid.

17. The method of claim 15, further comprising the steps of:

inserting the hooks of the lifting tool into a skimmer basket;

securing a skimmer basket handle using the hooks; and moving the skimmer basket by moving the lifting tool.

* * * * *